US005282909A

United States Patent [19]

Ara et al.

[11] Patent Number: 5,282,909

[45] Date of Patent: Feb. 1, 1994

[54] ALUMINUM ALLOY EXTRUSION MATERIAL WITH EXCELLENT CHIP SEPARATION PROPERTY AND PRECISION OF CUT FACE ON CUTTING

[75] Inventors: Chiaki Ara; Nagahide Kawasaki; Hidenori Joka, all of Tokyo; Tadashi Ohya; Atsushi Takai, both of Wako, all of Japan

[73] Assignees: Furukawa Aluminum Co., Ltd.; Honda Giken Kogyo Kabushiki Kaisha, both of Tokyo, Japan

[21] Appl. No.: 22,914

[22] Filed: Feb. 26, 1993

[30] Foreign Application Priority Data

Jun. 26, 1992 [JP] Japan ..... 4-192873

[51] Int. Cl.[5] ..... C22C 21/06

[52] U.S. Cl. ..... 148/439; 148/417; 420/530; 420/535

[58] Field of Search ..... 420/530, 535; 148/439, 148/417

[56] References Cited

U.S. PATENT DOCUMENTS 2,076,575 4/1937 Kempf et al. ..... 420/535

*Primary Examiner*—Melvyn J. Andrews
*Assistant Examiner*—Robert R. Koehler
*Attorney, Agent, or Firm*—Oblon, Spivak, McClelland, Maier & Neustadt

[57] ABSTRACT

An Al alloy extrusion material for the fuel-distributing pipe of automobile, consisting essentially of 0.3 to 1.0 wt. % of Si, 0.1 to 0.5 wt. % of Cu, 0.6 to 1.5 wt. % of Mg, 0.3 to 1.0 wt. % of Sn, 0.005 to 0.03 wt. % of Ti and the balance of Al and inevitable impurities and having uniformly dispersed Sn compounds with particle diameter of not more than 20 μm and density of 20 to 700 grains/mm$^2$ in the section perpendicular to the extrusion direction of material is disclosed, which is excellent in the chip separation property and the precision of cut face on cutting.

1 Claim, 1 Drawing Sheet

ALUMINUM ALLOY EXTRUSION MATERIAL WITH EXCELLENT CHIP SEPARATION PROPERTY AND PRECISION OF CUT FACE ON CUTTING

BACKGROUND OF THE INVENTION

The present invention relates to an Al alloy extrusion material for the fuel-distributing pipe of automobile, which improves, in particular, both characteristics of chip separation property and precision of cut face on cutting required for the extrusion material for fuel-distributing pipe used for automobile engine.

In the recent automobile engines, it has become common to use a system directly injecting the fuel into combustion chamber through electronic control for achieving lower pollution or higher output. For this reason, the fuel-distributing pipe is needed for fixing the fuel injection devices to engine and for supplying the fuel into individual fuel injection device, and various fuel-distributing pipes are used. So far, for the fuel-distributing pipe, cast pipe material made of iron or Al alloy has been used. In recent, however, for more improving the quality and the producibility, it has become to be made even with a hollow extrusion material made of aluminum alloy (JIS 6061 alloy; alloy of Al-0.6 wt. % Si-1.0 wt. % Mg-0.25 wt. % Cu-0.2 wt. % Cr). Besides, one example of mounting structure of fuel injection device (hereinafter, referred to as INJ) to the fuel-distributing pipe is shown in FIG. 1. Illustration will be made on FIG. 1. When using a hollow extrusion material (1) as a fuel-distributing pipe, as many holes (3) as the number of INJs are provided on this extrusion material, and INJ (5) is mounted to each of these holes (3) interposing O-ring (4). In the FIGURE, numeral (6) shows an air-intake port and numeral (2) a hole for the pathway of fuel for supplying fuel.

In this case, since the fuel leakage from the joined portion of the wall face of hole (3) of distributing pipe (1) with O-ring (4) of INJ is linked with a serious accident, the sealability of joined portion is considered to be an absolutely necessary condition, thus high precision is required for the precision of face after cutting of the wall face of hole (3) at INJ-mounting portion.

On the other hand, while said JIS 6061 alloy used recently for this fuel-distributing pipe of automobile is excellent in the point of surface precision after cutting, it is very poor in the chip separation property on cutting, arising a problem in the point of producibility.

Moreover, as a 6000-series Al Alloy having corrosion resistance and being free to cut, AA6262 alloy (alloy of Al-0.6 wt. % Si-1.0 wt. % Mg-0.25 wt. % Cu-0.1 wt. % Cr-Pb-Bi) is known hitherto. According to the investigating studies by the inventors, however, this alloy proved to have excellent chip separation property on cutting, but have poor surface precision of cut face on cutting.

For these reasons, the development of Al alloy extrusion material for the fuel-distributing pipe of automobile satisfying both characteristics of high precision cut face and good chip separation property has been earnestly sought for the improved producibility. Besides, in this specification, high precision cut face implies that the face roughness after cutting is very low and there are no defects such as falling on the cut face.

As a result of extensive investigating studies on the Al alloy extrusion material as a fuel-distributing pipe of automobile in view of such situation, the inventors have found that Pb and Bi used most often as improving elements in the cutting property of AA6262 alloy being conventional free cutting Al alloy deteriorate the precision of cut face. In consequence of further investigations, they have developed an Al alloy extrusion material for the fuel-distributing pipe of automobile having allowed both characteristics of high-precision cut face and chip separation property to be compatible by adding only Sn to Al-Mg-Si-Cu alloy and by optimizing the size and distribution density of crystallized grains of Sn compounds.

SUMMARY OF THE INVENTION

The invention provides an Al alloy extrusion material for the fuel-distributing pipe of automobile, characterized by comprising 0.3 to 1.0 wt. % of Si, 0.1 to 0.5 wt. % of Cu, 0.6 to 1.5 wt. % of Mg, 0.3 to 1.0 wt. % of Sn, 0.005 to 0.03 wt. % of Ti and the balance of Al and inevitable impurities and having uniformly dispersed Sn compounds with particle diameter of not more than 20 μm and density of 20 to 700 grains/mm$^2$ in the section perpendicular to the extrusion direction of material.

DETAILED DESCRIPTION OF THE INVENTION

Figure 1:
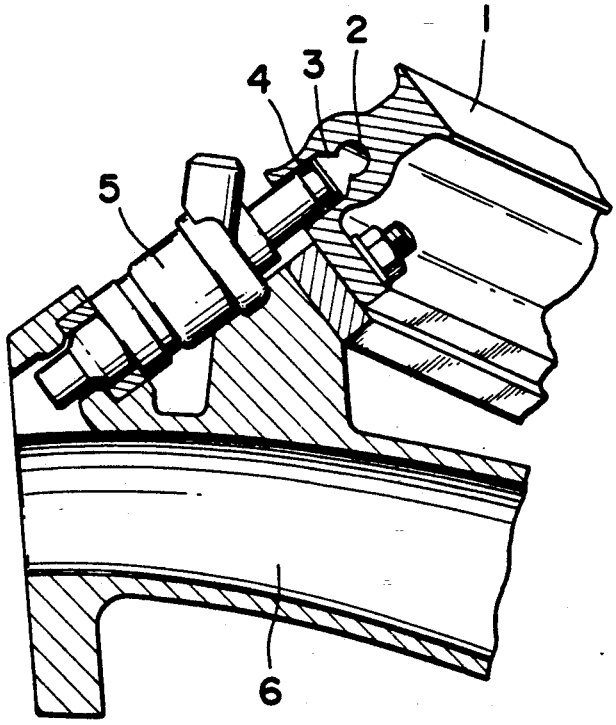
FIG. 1 is an illustration diagram showing one example of mounting structure of fuel injection device (INJ) to the fuel-distributing pipe made of Al alloy extrusion material.

The reasons why the content of addition elements in Al alloy of the Al alloy extrusion material for the fuel-distributing pipe of automobile of the invention were restricted as above are as follows:

Si: Si has an effect to improve the strength by precipitating very fine intermetallic compound $Mg_2Si$ through the aging precipitation treatment together with Mg. However, if the Si content is under 0.3 wt. %, then the improvement in strength by aging treatment will be insufficient and, if it is over 1.0 wt. %, excess Si will precipitate independently or as a Fe-Si type compound resulting in a cause deteriorating the precision of cut face and simultaneously remarkable abrasion of tool on cutting. Hence, the content of Si is restricted to the range from 0.3 to 1.0 wt. %.

Cu: Cu has an effect to improve the chip separation property and strength. If the Cu content is under 0.1 wt. %, then the improvement in strength will be insufficient and the chip separation property will be insufficient as well. If it is over 0.5 wt. %, the corrosion resistance of material will deteriorate. Hence, the content of Cu is restricted to the range from 0.1 to 0.5 wt. %.

Mg: Mg has an action to enhance the strength by forming solid solution in matrix and simultaneously an effect to improve the strength by precipitating very fine intermetallic compound $Mg_2Si$ through the aging precipitation treatment together with Si. In addition, it contributes to the chip separation property by precipitating a compound $Mg_2Sn$ in the coexistence with Sn.

However, if the Mg content is under 0.6 wt. %, the improvement in strength by aging treatment will be insufficient, whereas, if it is over 1.5 wt. %, the deformation resistance will become high leading to decreased extrudability and the cutting property decreases as well.

Hence, the content of Mg is restricted to the range from 0.6 to 1.5 wt. %.

Sn: Sn is important as an element to improve the chip separation property and to improve the precision of cut face as well by finely dispersing into the texture of material as Sn compounds ($Mg_2Sn$ etc.). If the Sn content is under 0.3 wt. %, then the effect on chip separation property will be insufficient and, if it is over 1.0 wt. %, the effect will reach the saturation and the face precision of extrusion material and the precision of cut face will deteriorate as well. Hence, the content of Sn is restricted to the range from 0.3 to 1.0 wt. %.

Ti: Ti has an effect to improve the precision of cut face by making the crystal grains fine. However, if the Ti content is under 0.005 wt. %, then the improvement effect on precision of cut face will be insufficient because of crystal grains not made fine and, if it is over 0.03 wt. %, the extrudability will be hindered and coarse precipitates will be produced leading to deteriorated precision of cut face as well. Hence, the content of Ti is restricted to the range from 0.005 to 0.03 wt. %.

Besides, the inevitable impurities such as Fe, Mn and Cr do not adversely influence particularly on the effect of the invention, if they are not more than 0.7 wt. %, not more than 0.2 wt. % and not more than 0.2 wt. %, respectively. They are permissible therefore, if the contents are within said ranges.

Yet, the Al alloy extrusion material being a material for the fuel-distributing pipe of the invention is not enough only with the prescription of ingredients as described above and it first exerts the improvement effect on the precision of cut face by prescribing the dimension and the dispersed state of precipitated grains of Sn compounds dispersing in the section perpendicular to the extrusion direction of said Al alloy extrusion material. It is required that the precipitated grains of Sn compounds are dispersed uniformly with individual particle diameter of not more than 20 μm and density of 20 to 700 grains/mm$^2$. This is because of that, if the individual particle diameter of precipitated grains of Sn compounds exceeds 20 μm, then the precision of cut face will be deteriorated, even if the density may be within the range restricted in the invention, and, if the density is under 20 grains/mm$^2$, the improvement effect on the cutting property will be insufficient lying the chips in a row, even if the individual particle diameter of precipitated grains of Sn compounds may be within the range restricted in the invention, and, if the density is over 700 grains/mm$^2$, the precision of cut face will be deteriorated, even if the individual particle diameter of precipitated grains of Sn compounds may be within the range restricted in the invention.

With the Al alloy extrusion material for the fuel-distributing pipe of automobile of the invention having such constitution, the chip separation property on cutting is good, the producibility can improve drastically, the face precision after cutting is excellent, and the sealability at the joined portion of hole wall of INJ-mounting portion of fuel-distributing pipe with O-ring of INJ can be retained in good state.

Moreover, since the Al alloy extrusion material according to the invention has equal to or more excellent cutting property and further more excellent precision of cut face than those of AA6262 alloy being a conventional free cutting alloy, it is suitable for the members requiring surface precision after cutting in the applications other than the fuel-distributing pipe for automobile.

In following, the invention will be illustrated in more detail based on the examples.

EXAMPLE 1

Alloys of the inventive examples (No. 1 through 11), alloys of the comparative examples (No. 12 through 19 and No. 20 AA6262 alloy being conventional free cutting Al alloy) and alloy of conventional example (No. 21 JIS6061 alloy) having compositions shown in Table 1 were molten and cast according to the usual method to fabricate 230 mm diameter ingot for each alloy. After the homogenizing treatment for 4 hours at 480° C., it was extruded to 30 mm diameter round bar by hot extrusion method adjusting the extrusion die to 480° to 550° C., which was hardened by cooling with water immediately after the extrusion. Then, this was submitted to the high-temperature aging treatment for 8 hours at 175° C. to obtain T5 refined sample material.

TABLE 1

| | | | Alloy composition (wt. %) | | | | | | | | |
|---|---|---|---|---|---|---|---|---|---|---|---|
| | | No. | Si | Cu | Mg | Sn | Cr | Ti | Pb | Bi | Al and inevitable impurities |
| Inventive example | | 1 | 0.32 | 0.30 | 1.03 | 0.52 | — | 0.015 | — | — | Balance |
| | | 2 | 0.98 | 0.33 | 1.16 | 0.55 | — | 0.018 | — | — | Balance |
| | | 3 | 0.38 | 0.12 | 1.08 | 0.47 | — | 0.023 | — | — | Balance |
| | | 4 | 0.51 | 0.49 | 0.98 | 0.51 | — | 0.022 | — | — | Balance |
| | | 5 | 0.59 | 0.32 | 0.62 | 0.53 | — | 0.019 | — | — | Balance |
| | | 6 | 0.49 | 0.29 | 1.48 | 0.49 | — | 0.022 | — | — | Balance |
| | | 7 | 0.52 | 0.30 | 1.04 | 0.31 | — | 0.020 | — | — | Balance |
| | | 8 | 0.61 | 0.33 | 0.99 | 0.98 | — | 0.019 | — | — | Balance |
| | | 9 | 0.58 | 0.31 | 1.08 | 0.54 | — | 0.006 | — | — | Balance |
| | | 10 | 0.60 | 0.28 | 1.16 | 0.47 | — | 0.029 | — | — | Balance |
| | | 11 | 0.35 | 0.32 | 1.04 | 0.33 | — | 0.007 | — | — | Balance |
| Comparative example | | 12 | 1.53 | 0.30 | 1.05 | 0.48 | — | 0.022 | — | — | Balance |
| | | 13 | 0.60 | 0.06 | 1.07 | 0.53 | — | 0.018 | — | — | Balance |
| | | 14 | 0.58 | 0.31 | 2.11 | 0.50 | — | 0.016 | — | — | Balance |
| | | 15 | 0.49 | 0.30 | 1.13 | 0.25 | — | 0.022 | — | — | Balance |
| | | 16 | 0.52 | 0.27 | 1.08 | 1.22 | — | 0.018 | — | — | Balance |
| | | 17 | 0.48 | 0.29 | 1.11 | 0.48 | — | 0.045 | — | — | Balance |
| | | 18 | 0.43 | 0.32 | 1.04 | 0.51 | — | 0.022 | — | — | Balance |
| | | 19 | 0.50 | 0.29 | 1.01 | 0.52 | — | 0.021 | — | — | Balance |
| | AA6262 | 20 | 0.57 | 0.27 | 1.06 | — | 0.10 | 0.023 | 0.53 | 0.51 | Balance |
| Conventional example | JIS6061 | 21 | 0.63 | 0.25 | 0.97 | — | 0.23 | 0.014 | — | — | Balance |

Of the extrusion material fabricated by the method aforementioned, a section perpendicular to the extrusion direction was mirror-polished, and, using computer image analysis method, the absolute maximum particle diameter of individual grain and the number of grains per unit area of precipitated grains of Sn compounds were automatically determined on a photograph of the image of Sn compounds taken with X-ray microanalyzer. Repeatedly determined average values were shown in Table 2 under the expression of particle diameter and density, respectively.

TABLE 2

| | | No. | Particle diameter (μm) | Density (grains/mm$^2$) |
|---|---|---|---|---|
| Inventive example | | 1 | 5.0 | 228 |
| | | 2 | 16.5 | 384 |
| | | 3 | 5.8 | 216 |
| | | 4 | 6.5 | 333 |
| | | 5 | 7.4 | 379 |
| | | 6 | 6.0 | 285 |
| | | 7 | 5.5 | 25 |
| | | 8 | 8.9 | 637 |
| | | 9 | 7.7 | 98 |
| | | 10 | 5.1 | 165 |
| | | 11 | 16.6 | 22 |
| Comparative example | | 12 | 18.7 | 75 |
| | | 13 | 9.6 | 188 |
| | | 14 | 8.5 | 328 |
| | | 15 | 3.8 | 25 |
| | | 16 | 10.2 | 672 |
| | | 17 | 16.0 | 221 |
| | | 18 | 36.5 | 27 |
| | | 19 | 3.2 | 1096 |
| | AA6262 | 20 | 5.9 | 185 |
| Conventional example | JIS6061 | 21 | 0 | 0 |

Moreover, the hardness, chip separation property and surface roughness after cutting of sample material were measured for comparison by the methods shown below.

The hardness as an index representing the strength was measured with Rockwell B Scale after mirror-polishing the section of sample material.

For the cutting test, cutting was performed on an automatic turning machine with carbide tool having a rake angle of 5° at a number of revolutions to make the peripheral speed of sample material 100 m/min under the conditions of depth of cut of 2 mm, feed speed of 0.1 mm/rev and no lubrication. The reason why the cutting conditions were made as above is because of that the conditions of high-speed cutting may be reproduced as experimentally as possible taking the producibility at the actual production field into consideration.

And, sampling the chips having been cut, the weight per 100 pieces of chip was measured. By the way, it becomes that the lighter this weight, the more excellent the chip separation property.

Moreover, the surface roughness of the surface after cutting was measured in the direction perpendicular to the cutting direction, which was expressed in terms of maximum height (Rmax) prescribed in JIS B0601.

The test results are shown in Table 3.

TABLE 3

| | | No. | Hardness (HRB) | Chip separation property (g/100 pieces) | Roughness of cut face (Rmax) |
|---|---|---|---|---|---|
| Inventive example | | 1 | 53 | 6.32 | 4.77 |
| | | 2 | 68 | 4.84 | 5.32 |
| | | 3 | 53 | 7.14 | 4.72 |
| | | 4 | 61 | 5.23 | 3.97 |
| | | 5 | 52 | 5.03 | 4.01 |
| | | 6 | 65 | 5.71 | 5.86 |
| | | 7 | 54 | 6.90 | 5.15 |
| | | 8 | 55 | 4.84 | 3.26 |
| | | 9 | 54 | 6.68 | 4.28 |
| | | 10 | 56 | 5.42 | 3.80 |
| | | 11 | 53 | 7.25 | 6.22 |
| Comparative example | | 12 | 72 | 4.51 | *15.81 |
| | | 13 | *44 | 9.63 | 6.22 |
| | | 14 | 76 | *15.26 | *12.52 |
| | | 15 | 52 | *11.92 | 6.44 |
| | | 16 | 54 | 4.06 | *21.30 |
| | | 17 | 50 | 6.22 | *18.61 |
| | | 18 | 53 | 9.08 | *15.33 |
| | | 19 | 54 | 6.25 | *16.55 |
| | AA6262 | 20 | 53 | 7.80 | *11.73 |
| Conventional example | JIS6061 | 21 | 55 | *12.34 | 7.37 |

In the table, * mark means unsuitable value.

As evident from Table 3, it was confirmed that alloys of the inventive examples No. 1 through 11 satisfied all characteristics of hardness, chip separation property and precision of cut face. Moreover, in particular, it can be seen that the precision of cut face improves slightly, but the chip separation property is remarkably excellent.

Whereas, it is seen that comparative examples No. 12 through 20 are poor in any of hardness, chip separation property and precision of cut face characteristics.

EXAMPLE 2

Alloy No. 5 (Alloy of inventive example), alloy No. 20 (AA6262 alloy of comparative example) and alloy No. 21 (JIS 6061 alloy of conventional example), the alloy compositions being shown in Table 1 of Example 1 above, were extruded similarly to Example 1 into a shape of fuel-distributing pipe (shape having a hole (2) for the pathway of fuel in the center of section) as shown in FIG. 1 and hardened by cooling with water immediately after the extrusion. Then, these were submitted to the high-temperature aging treatment for 8 hours at 175° C. to fabricate T5 refined test materials. Using these test materials, drilling of 9.5 mmϕ hole (3) for inserting INJ was carried out each 20 times in the direction perpendicular to the hole (2) for the pathway of fuel as shown in FIG. 1.

As a result of such test, it was confirmed that, with the Al alloy extrusion material according to the invention, the chip separation property was excellent, the efficiency of drilling operation improved, and the face precision of hole wall was also excellent. On the other hand, with conventional JIS6061 alloy extrusion material, the face precision of hole wall was good, but the chips lay in a row leading to very bad operativity and poor producibility. Moreover, with the AA6262 alloy extrusion material used as a comparative material, the chip separation property was good, but the face roughness of hole wall was high and the galling was caused leading to poor results.

As described above, the Al alloy extrusion material for the fuel-distributing pipe of automobile in accordance with the invention has equal mechanical property and very excellent chip separation property over the conventional JIS6061 alloy extrusion material, hence it can conspicuously improve the machining producibility of fuel-distributing pipe. Moreover, the precision of cut face after drilling of fuel-distributing pipe is also equal to or higher than that of conventional JIS 6061 alloy extrusion material. Hence, the invention is signifficant industrially.

What is claimed is:

1. An Al alloy extrusion material for the fuel-distributing pipe of automobile with excellent chip separation property and precision of cut face on cutting, consisting essentially of 0.3 to 1.0 wt. % of Si, 0.1 to 0.5 wt. % of Cu, 0.6 to 1.5 wt. % of Mg, 0.3 to 1.0 wt. % of Sn, 0.005 to 0.03 wt. % of Ti and the balance of Al and inevitable impurities and having uniformly dispersed Sn compounds with particle diameter of not more than 20 μm and density of 20 to 700 grains/mm$^2$ in the section perpendicular to the extrusion direction of material.

* * * * *